US010822818B2

(12) United States Patent
Harmon

(10) Patent No.: US 10,822,818 B2
(45) Date of Patent: Nov. 3, 2020

(54) CAGE ASSEMBLY FOR USE WITH PIVOTAL GANGWAY

(71) Applicant: Safe Rack LLC, Andrews, SC (US)

(72) Inventor: Charles Frederick Harmon, Sumter, SC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 16/118,350

(22) Filed: Aug. 30, 2018

(65) Prior Publication Data

US 2018/0371768 A1 Dec. 27, 2018

Related U.S. Application Data

(62) Division of application No. 15/285,722, filed on Oct. 5, 2016, now Pat. No. 10,087,641.

(60) Provisional application No. 62/238,296, filed on Oct. 7, 2015.

(51) Int. Cl.
*B66F 11/04* (2006.01)
*E04G 5/14* (2006.01)

(52) U.S. Cl.
CPC ..... *E04G 5/14* (2013.01); *B66F 11/04* (2013.01)

(58) Field of Classification Search
CPC ..... B66F 11/04
See application file for complete search history.

(56) References Cited

U.S. PATENT DOCUMENTS

| | | | | |
|---|---|---|---|---|
| 4,422,485 | A * | 12/1983 | O'Shea | B67D 7/00 105/241.1 |
| 4,572,328 | A | 2/1986 | Benko | |
| 4,630,708 | A | 12/1986 | Thompson | |
| 4,679,657 | A | 7/1987 | Bennett et al. | |
| 5,634,529 | A | 6/1997 | Nguyen et al. | |
| 6,464,037 | B2 | 10/2002 | Baldas et al. | |
| 7,216,741 | B2 * | 5/2007 | MacDonald | B66F 11/04 182/113 |
| 7,950,095 | B2 | 5/2011 | Honeycutt et al. | |
| 8,015,647 | B2 | 9/2011 | Bennett | |
| 8,403,109 | B2 | 3/2013 | Bennett | |
| 8,479,882 | B2 | 7/2013 | DuBose et al. | |
| 8,662,251 | B2 | 3/2014 | Hansen | |
| 8,726,577 | B2 | 5/2014 | Whiting | |
| 8,745,799 | B1 * | 6/2014 | Thomasson | B65G 69/22 14/31 |
| 8,746,403 | B1 | 6/2014 | Tyner et al. | |

(Continued)

*Primary Examiner* — Alvin C Chin-Shue
(74) *Attorney, Agent, or Firm* — Nelson Mullins Riley & Scarborough, LLP

(57) ABSTRACT

A cage assembly configured to raise and lower with respect to a container which has an opening closed by a hatch cover. The cage assembly comprises a rail structure having a proximal side, a distal side, and first and second ends defining a generally rectangular enclosed area in which a worker can stand. The rail structure further defines an opening in the proximal side so that a worker can access the enclosed area. Moreover, the rail structure further comprises a plurality of parallel rails including a top rail and a lower rail, with the top rail having a generally rectangular configuration to define the enclosed area. A respective bump out is defined by the rail structure on at least one of the proximal and distal sides thereof to facilitate opening of the hatch cover. The bump out is formed at least in part by a configuration of the lower rail.

2 Claims, 8 Drawing Sheets

(56) References Cited

U.S. PATENT DOCUMENTS

| | | | | |
|---|---|---|---|---|
| 8,813,912 | B2 | 8/2014 | Bennett et al. | |
| 9,027,712 | B2 | 5/2015 | Melton et al. | |
| 9,169,693 | B2 | 10/2015 | Honetcutt | |
| 9,273,475 | B1 | 3/2016 | DuBose et al. | |
| 2011/0078864 | A1* | 4/2011 | Bennett ..... | B65G 69/22 14/71.7 |
| 2012/0006618 | A1 | 1/2012 | DuBose et al. | |
| 2014/0225052 | A1 | 8/2014 | Whiting | |

* cited by examiner

CAGE ASSEMBLY FOR USE WITH PIVOTAL GANGWAY

PRIORITY CLAIM

This application is a divisional of U.S. utility application Ser. No. 15/285,722, filed Oct. 5, 2016, which is based upon and claims the benefit of U.S. provisional patent application Ser. No. 62/238,296, filed Oct. 7, 2015. Both of the foregoing applications are incorporated by reference herein in their entireties for all purposes.

FIELD OF THE INVENTION

The present invention relates to fall restraint equipment, and more particularly, to a cage located at the distal end of a pivotal gangway.

BACKGROUND OF THE INVENTION

Fall restraint equipment may include platforms, ramps, bridges, steps, guardrails, gangways, cages, and other structures. Gangways, for instance, may be used to provide access to an area, such as the top of a storage container. For example, a semi-trailer truck or a railroad carriage transporting loadable material may need to be loaded or unloaded from the container's top. A gangway is used to provide workers a path to an access hatch on top of the container. A cage may be located at the distal end of the gangway to surround the area on top of the container where the worker will be standing.

The access hatch is generally pivoted on an axis parallel to the longitudinal axis of the container. With a traditional rectangular cage, it may not be possible to open the hatch cover entirely. This is because the railings of the cage interfere with the hatch cover as it is pivoted to its open position. It will be appreciated that a partially open hatch cover may make loading or unloading of the container contents more difficult.

An effort to address this concern is disclosed in U.S. Pat. No. 7,216,741. That patent shows an arrangement wherein portions of the cage's rail structure are configured to pivot in and up so as to allow more room for the hatch cover to open. Further room for improvement exists in the art.

SUMMARY OF THE INVENTION

The present invention recognizes and addresses the foregoing considerations, and others, of prior art construction and methods.

One aspect of the present invention provides a cage assembly configured to raise and lower with respect to a container having an opening closed by a hatch cover. The cage assembly comprises a rail structure having a proximal side, a distal side, and first and second ends defining a generally rectangular enclosed area in which a worker can stand. The rail structure further defines an opening in the proximal side so that a worker can access the enclosed area. Moreover, the rail structure further comprises a plurality of parallel rails including a top rail and a lower rail, with the top rail having a generally rectangular configuration to define the enclosed area. A respective bump out is defined by the rail structure on at least one of the proximal and distal sides thereof to facilitate opening of the hatch cover. The bump out is formed at least in part by a configuration of the lower rail.

In some exemplary embodiments, the bump out further comprises a contour rail depending below the lower rail such that the contour rail will be located in a gap between the lower rail and an outer surface of the container. Preferably, the contour rail may have an intermediate portion extending in parallel to and vertically aligned with a portion of the lower rail. In addition, at least one cross piece may preferably extend between the contour rail and the lower rail.

Embodiments are contemplated in which the rail structure further includes a mid rail, the bump out being formed in part by a configuration of the mid rail. In such embodiments, the bump out may have a sloped configuration due to the mid rail positioned laterally less than the lower rail.

In some embodiments, the bump out may be located across from the opening. In other embodiments, the bump out comprises first and second bump outs located on the proximal side and the distal side of the rail structure, respectively.

According to another aspect, the present invention provides an apparatus comprising a gangway having a proximal end and a distal end. A cage assembly is connected to the distal end of the gangway, the cage assembly including a rail structure having a proximal side, a distal side, and first and second ends. The rail structure defines an enclosed area in which a worker can stand and further defines an opening in the proximal side, aligned with said gangway, so that a worker can access the enclosed area. A respective bump out is defined on at least one of the proximal and distal sides of the rail structure to facilitate opening of a hatch cover.

A still further aspect of the present invention provides an apparatus comprising a gangway having a proximal end and a distal end. A cage assembly is connected to the distal end of the gangway, the cage assembly including an enclosure structure having a proximal side, a distal side, and first and second ends. A top of the enclosure structure defines a generally rectangular enclosed area in which a worker can stand. The enclosure structure further defines an opening in the proximal side, aligned with the gangway, so that a worker can access the generally rectangular enclosed area. In addition, the enclosure structure defines a respective bump out on at least one of the proximal and distal sides thereof to facilitate opening of a hatch cover.

The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
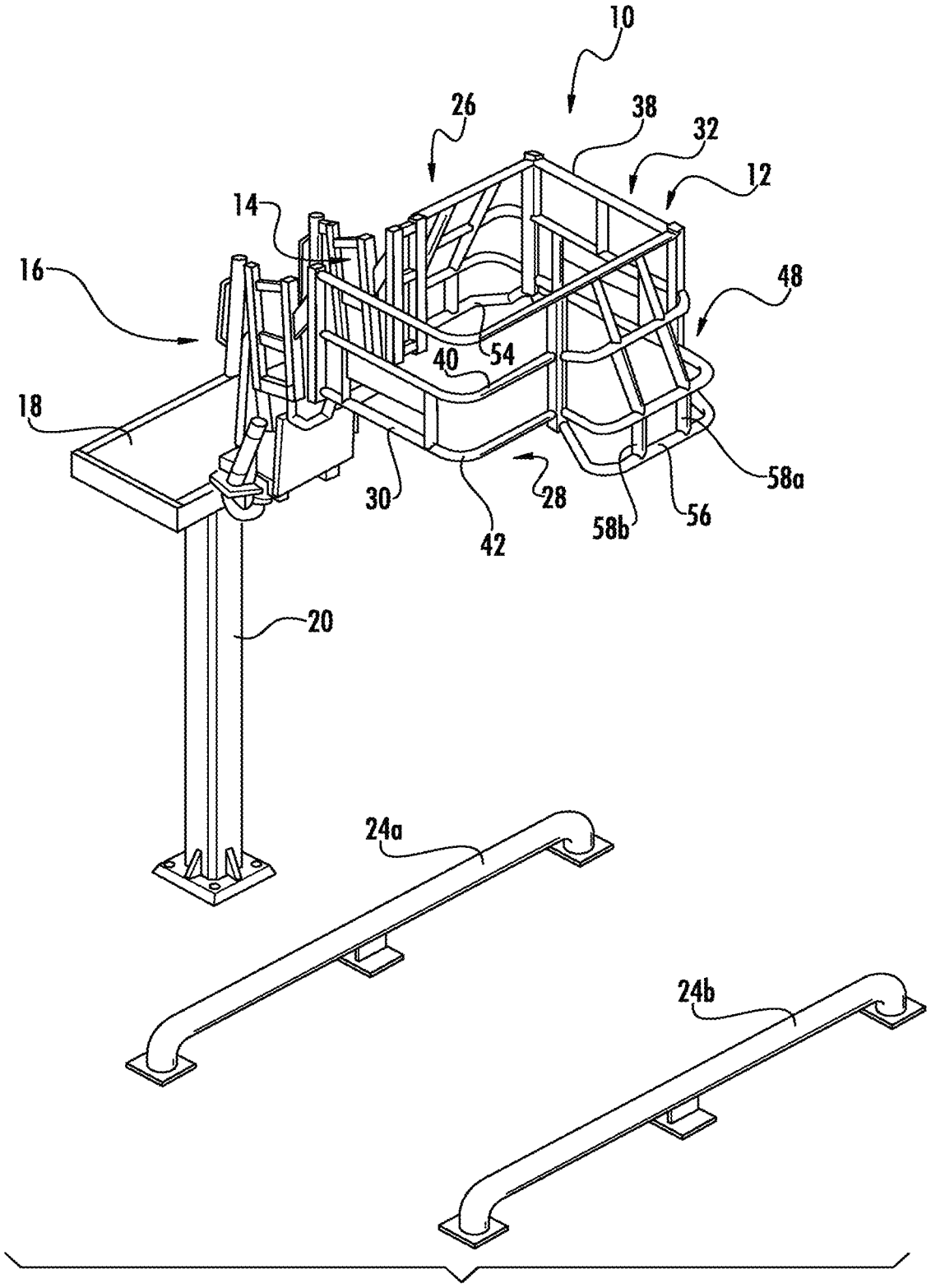
FIG. 1 is an isometric view of a cage assembly in accordance with an embodiment of the present invention connected to the distal end of a platform-mounted gangway in stored position.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates a cage assembly 10 constructed in accordance with an embodiment of the present invention. As shown, cage assembly 10 includes a rail structure 12 defining an enclosed area, generally rectangular in shape, within which a worker can stand when cage assembly 10 is lowered into the working position. Rail structure 12 defines an opening 14 through which the worker would access the enclosed area. In addition, cage assembly 10 is connected to the distal end of a pivotal gangway 16. The proximal end of gangway 16 is pivotally connected in this case to a fixed platform 18 located at the appropriate height. Platform 18 is appropriately supported, such as by one or more support column(s) 20. Examples of suitable gangways that may be used with embodiments of the present invention are shown in U.S. Pat. No. 7,950,095, incorporated fully herein by reference for all purposes.

Figure 2:
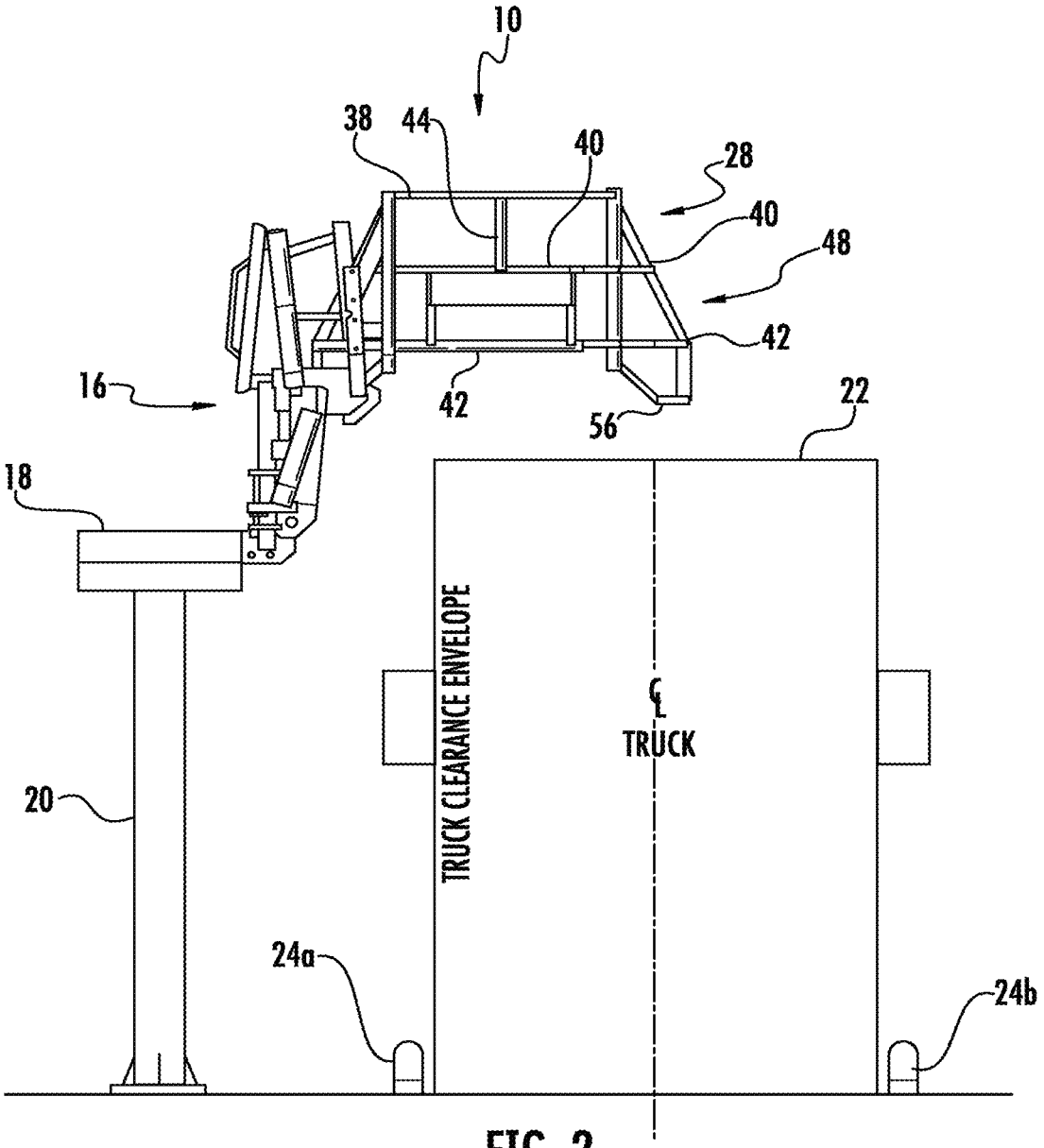
FIG. 2 is a side elevation of the gangway and cage assembly of FIG. 1.

Referring now to FIGS. 1 and 2, gangway 16 is shown in stowed (i.e., raised) position. As a result, cage assembly 10 will be located above the expected maximum height of a storage container with which it might be used. This maximum height is represented in FIG. 2 by the "truck clearance envelope" 22. Preferably, spaced apart guide rails 24*a-b* may be fixed on the ground below cage assembly 10 to ensure that the container is at the appropriate lateral position relative to the platform. The appropriate axial location relative to the container's path of travel can be judged by a worker as the container moves into position.

Figure 3:
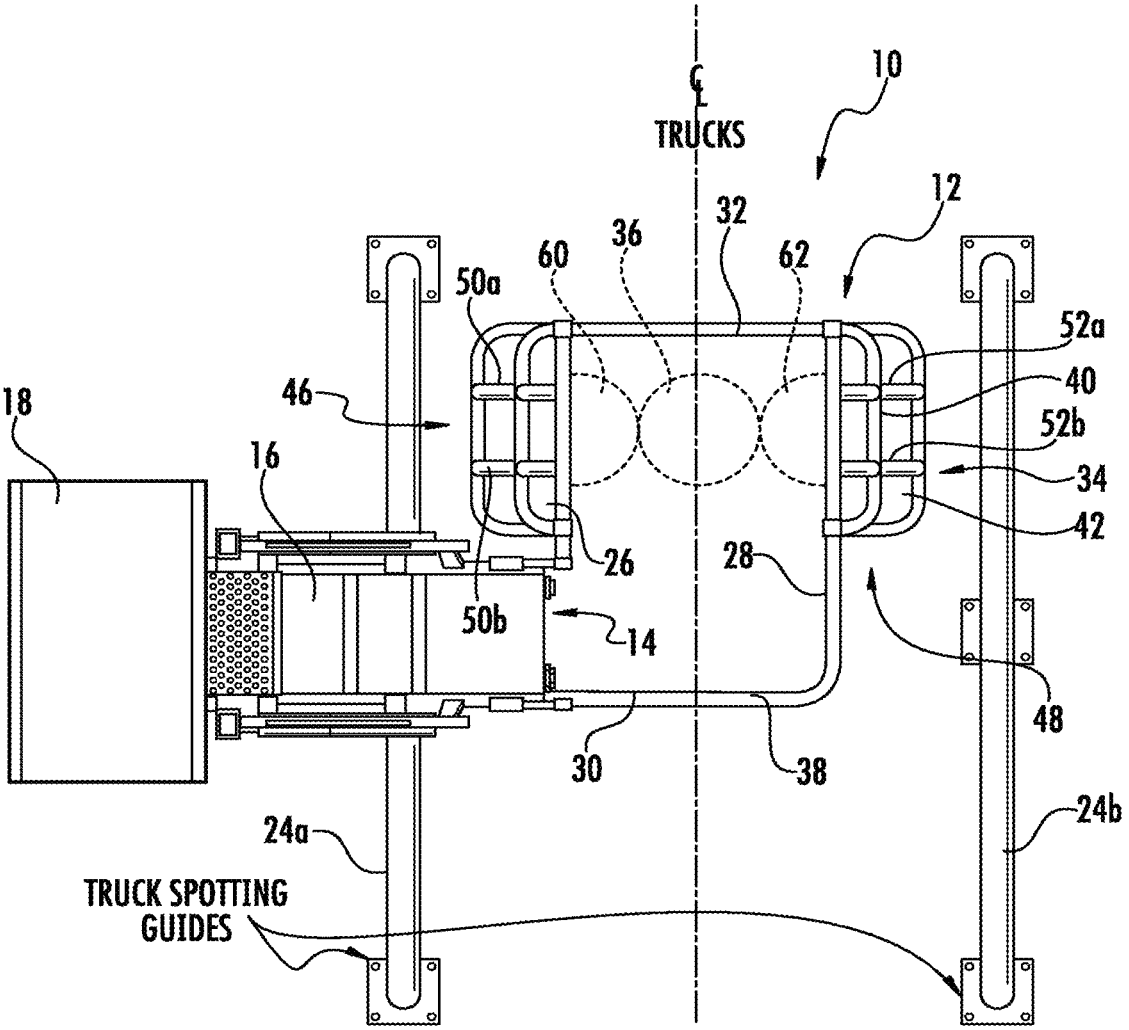
FIG. 3 is a plan view of the gangway and cage assembly of FIG. 1 with the gangway horizontal to show hatch cover locations.

Referring now also to FIG. 3, certain additional details regarding cage assembly 10 can be described. As shown, gangway 16 aligns with opening 14 in the rail structure 12. Typically, gangway 16 may have a series of self-leveling stairs that the worker would traverse going from platform 18 to the top of the container. In other embodiments, the upper surface of gangway 16 may be configured as a ramp.

Generally, rail structure 12 has a proximal side 26, a distal side 28, a first end 30, and a second end 32 which define the enclosed area. As shown, proximal side 26 is shorter in this embodiment than distal side 28, thus defining opening 14. The reminder of the enclosed area defines an offset portion 34 that will be aligned with hatch cover 36 when cage assembly 10 is in the working position.

Rail structure 12 will generally be constructed having a plurality of horizontal rails interconnected by generally vertical cross pieces. In this case, rail structure 12 includes a top rail 38, a mid rail 40, and a lower rail 42 that are all in parallel with each other. An exemplary cross piece is indicated at 44 (FIG. 2).

Referring again particularly to FIGS. 2 and 3, it can be seen that top rail 38 defines the rectangular shape of the enclosed area. Moreover, mid rail 40 and lower rail 42 are vertically aligned with top rail 38 around much of the enclosed area. In offset portion 34, however, mid rail 40 and lower rail 42 form respective bump outs 46 and 48 that provide additional lateral spacing between proximal side 26 and distal side 28 of rail structure 12. As can be seen, the lateral spacing is greater at lower rail 42 than at mid rail 40. A pair of sloped cross pieces 50*a-b* extend between the "bumped out" rails on the inboard side of cage structure 12. Similarly, a pair of sloped cross pieces 52*a-b* extend between the "bumped out" rails on the outboard side of cage structure 12.

As can be seen most clearly with reference to FIGS. 1 and 2, each of the bump outs 46 and 48 further includes a respective contour rail 54 and 56 located below lower rail 42. The ends of contour rails 54 and 56 converge toward lower rail 42 at the locations where it diverges laterally with respect to top rail 38. The intermediate portion of respective contour rails 54 and 56 extends substantially in parallel with lower rail 42. Preferably, one or more vertical cross pieces, such as those indicated at 58*a-b*, span the space between lower rail 42 and contour rails 54 and 56.

Referring now to FIG. 3, some situations will require swinging the hatch cover 36 toward the inboard side and others would require swinging toward the outboard side (depending on the location of the pivot axis and the orientation of the container). As indicated at 60 and 62, bumps outs 46 and 48 allow the hatch cover 36 to swing in either lateral direction to a fully opened position where it will typically rest against the outer surface of the container. Thus, the configuration of cage assembly 10 allows the hatch cover to open fully but otherwise serves to keep the worker in the enclosed area (due to the rectangular shape of top rail 38).

Figure 4B:
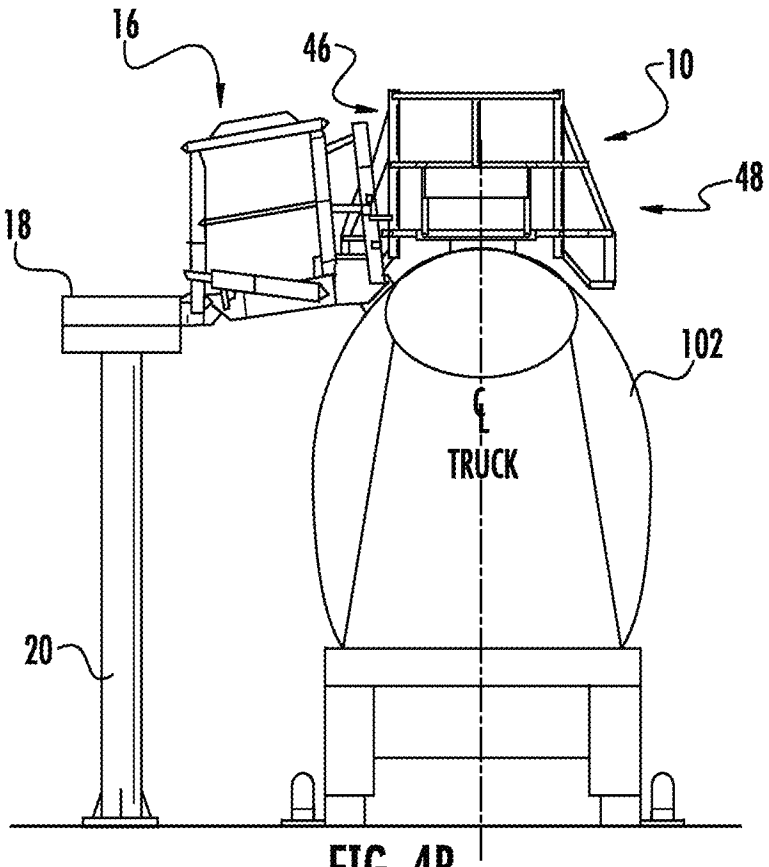
FIGS. 4A and 4B show the gangway and cage assembly of FIG. 1 in shorter and taller working positions, respectively.
Figure 4A:
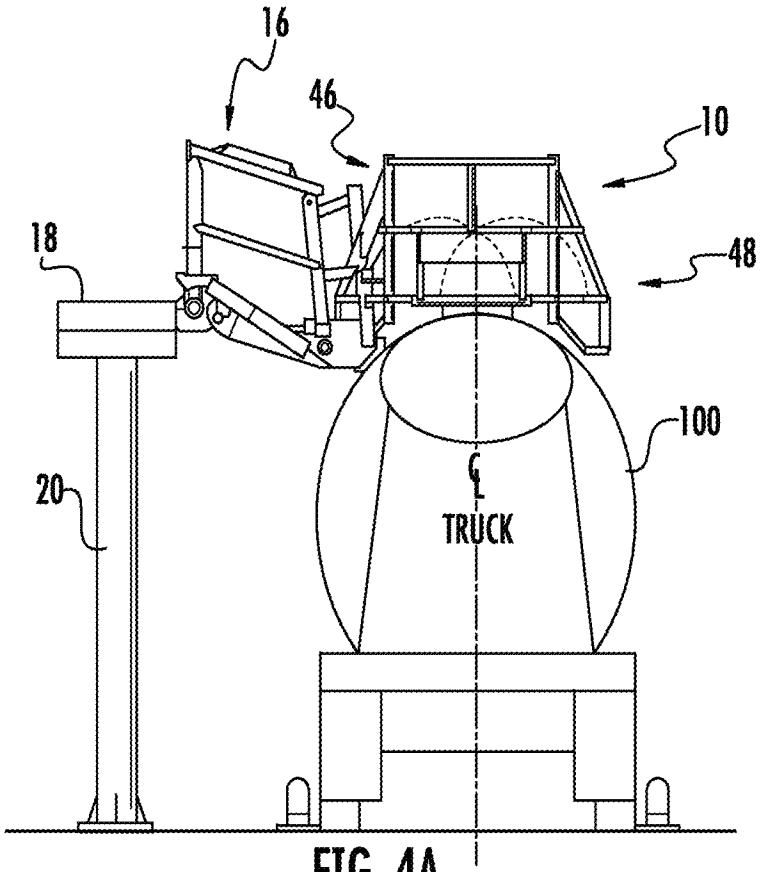

Referring now to FIGS. 4A and 4B, cage assembly 10 is shown lowered into its working position relative to a shorter container 100 and a taller container 102, respectively. In either case, however, the bump outs 46 and 48 will wrap down to the outer diameter of the container body. Thus, respective contour rails 54 and 56 (and their associated cross pieces) effectively fill a gap that might otherwise exist below lower rail 42 due to the bump outs when cage assembly 10 is in the working position.

Figure 5:
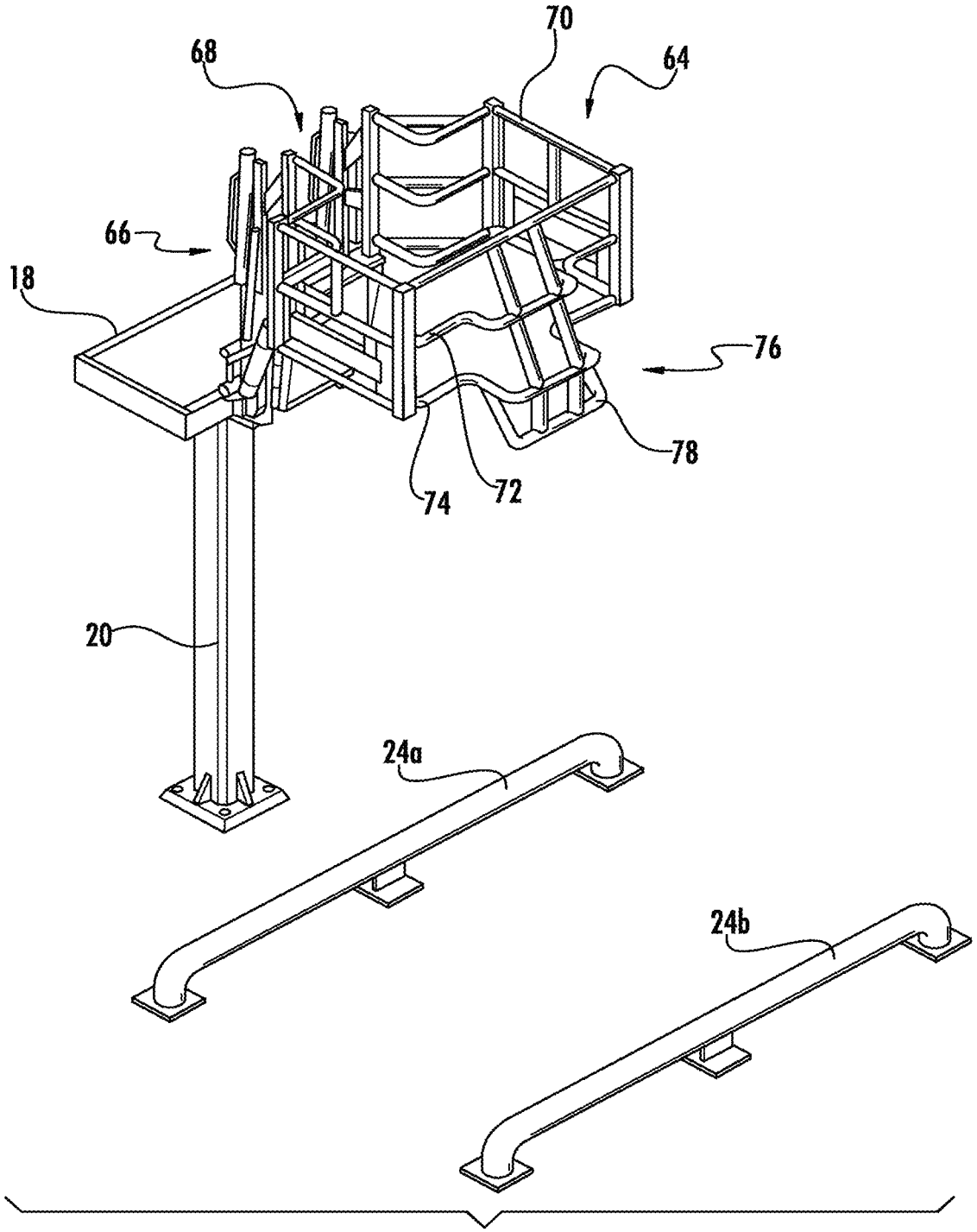
FIG. 5 is an isometric view of a cage assembly in accordance with an embodiment of the present invention connected to the distal end of a platform-mounted gangway in stored position.
Figure 6:
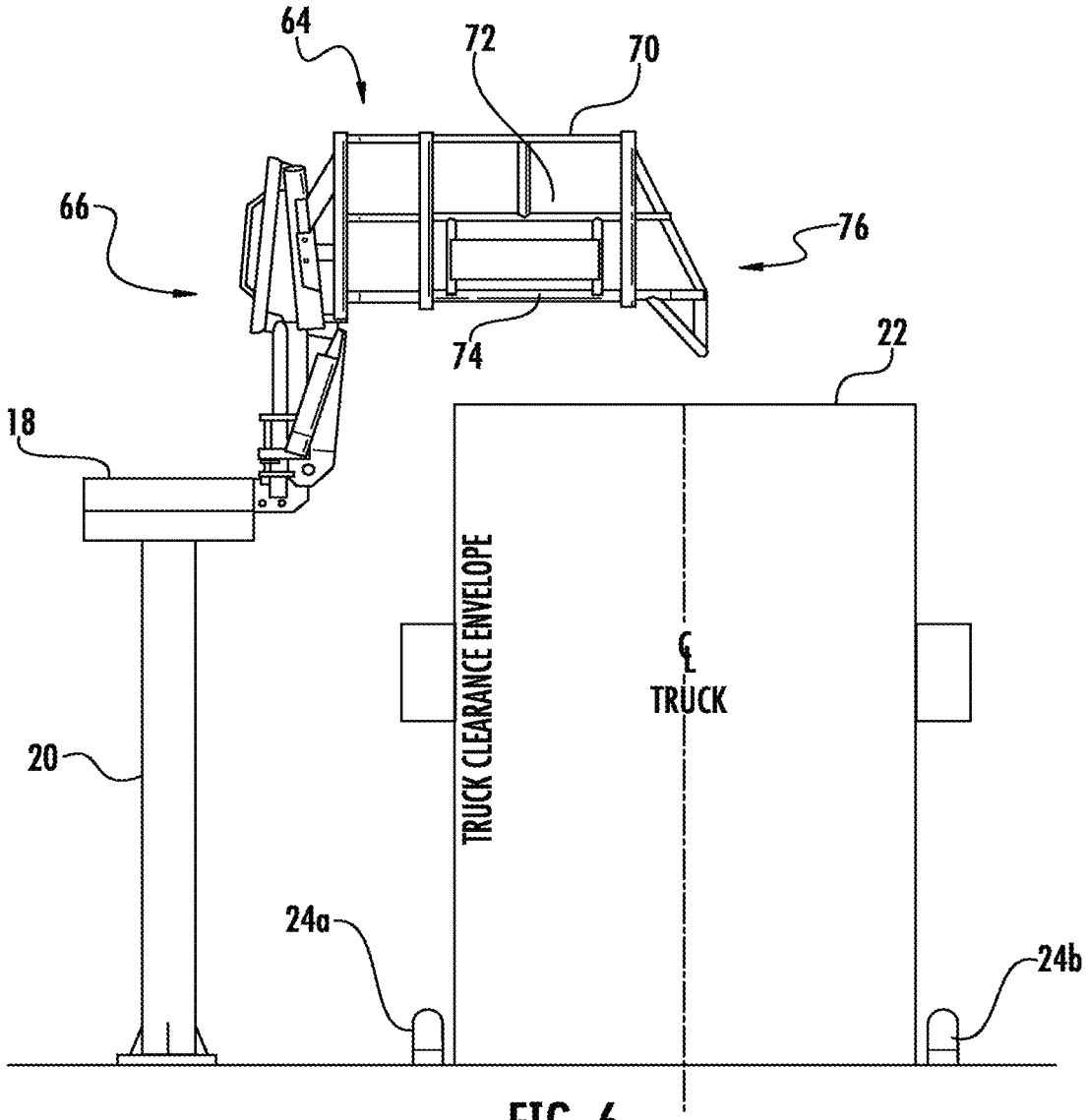
FIG. 6 is a side elevation of the gangway and cage assembly of FIG. 5.

Other embodiments in accordance with the present invention are also contemplated. In this regard, FIGS. 5 and 6 illustrate an alternative cage assembly 64 connected at the distal end of a gangway 66. The proximal end of gangway 66 is pivotally connected to platform 18, which is supported at the appropriate height (e.g., by support column(s) 20).

Figure 7:
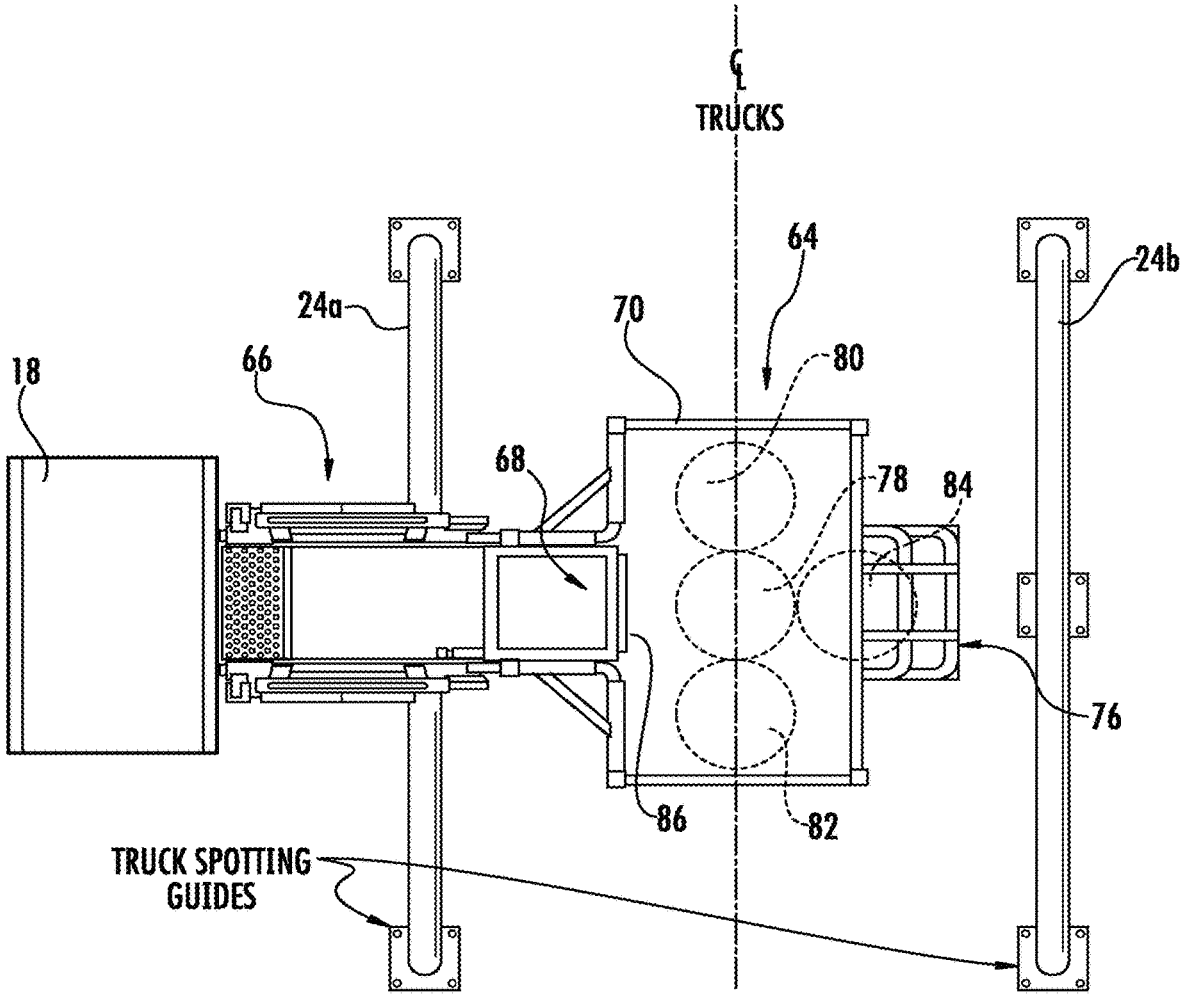
FIG. 7 is a plan view of the gangway and cage assembly of FIG. 5 with the gangway horizontal to show hatch cover locations.

Referring now also to FIG. 7, cage assembly 64 defines an enclosed area that is accessed by an opening 68 aligned with the distal end of gangway 66. Opening 68 is centrally located along the proximal (inboard) side of cage assembly 64. As shown, the enclosed area of cage assembly 64 is defined by the generally rectangular shape of top rail 70. Mid rail 72 and lower rail 74 are vertically aligned on the inboard side of cage assembly 64, as well as the two ends. However, along the central portion of the distal (outboard) side of cage assembly 64, mid rail 72 and lower rail 74 are configured to form a bump out 76. Thus, in this embodiment, bump out 76 is preferably located directly across from opening 68 on the distal (outboard) side of cage assembly 64. Preferably, bump out 76 further includes a contour rail 78, and associated cross pieces, similar to those described above.

As can be seen most clearly in FIG. 7, the container may be positioned so that its hatch cover 78 is located between opening 68 and bump out 76. Thus, in contrast to the offset arrangement of cage assembly 10, cage assembly 64 has a cross cage arrangement. This configuration is particularly useful in situations where the pivot axis of the hatch cover is transverse to the longitudinal axis of the container. As a result, the hatch cover may swing fully open (as shown at 80 or 82) notwithstanding location of the pivot axis on the leading or trailing side of the hatch, or the direction in which the container is oriented. (Note that the first and second ends of cage assembly 64 should be spaced sufficient to allow the hatch cover to fully open in either leading or trailing directions.) In addition, a hatch with an axially-aligned pivot axis may full open into the space provided by bump out 76, as indicated at 84, or into the opening 68.

In this embodiment, it may be desirable to provide gangway 66 with a slidable extension 86 that retracts under the main portion of gangway 66. Extension 86 can be extended when gangway 66 is lowered into the working position to span any gap with the top surface of the container. In a preferred embodiment, extension 86 will be positioned downward to fill the gap between gangway 66 and the container while allowing the hatch cover 78 to be opened over extension 86. As a result, the hatch cover can be fully opened without interference from gangway 66. Extension 86 can be subsequently retracted by the worker before gangway 66 is moved to the stored position.

Figure 8B:
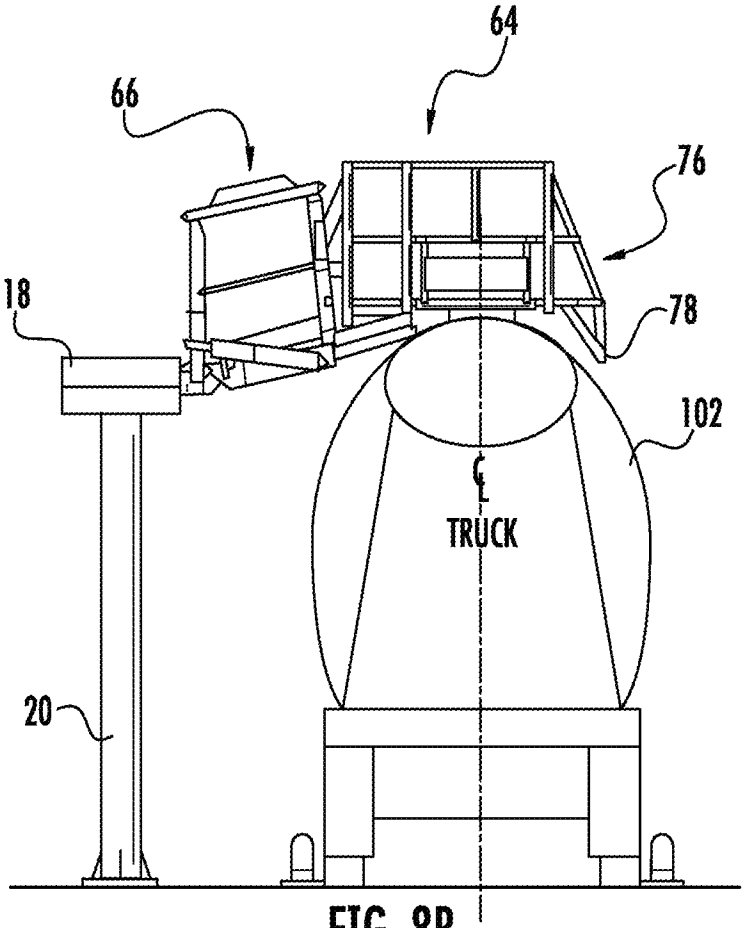
FIGS. 8A and 8B show the gangway and cage assembly of FIG. 5 in shorter and taller working positions, respectively.
Figure 8A:
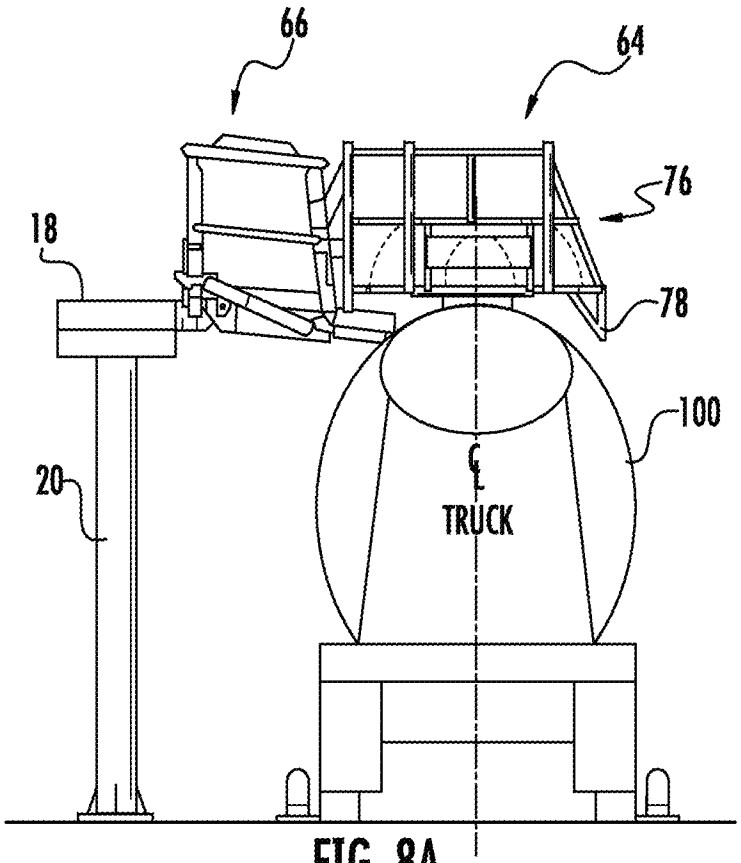

Referring now to FIGS. 8A and 8B, cage assembly 10 is lowered into its working position relative to shorter container 100 and taller container 102, respectively. As shown, bump out 76 wraps down to the outer diameter of the container body on the side opposite to gangway 66. Thus, contour rail 78 (and its associated cross pieces) effectively fills a gap that might otherwise exist under lower rail 74 when cage assembly 64 is in the working position.

It can thus be seen that the present invention provides various novel cage configurations for use at the distal end of a gangway. While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. Apparatus comprising:

a gangway having a proximal end and a distal end;

a cage assembly connected to the distal end of the gangway, said cage assembly including an enclosure structure having a proximal side, a distal side, and first and second ends;

a top of said enclosure structure defining a generally rectangular enclosed area in which a worker can stand;

said enclosure structure defining an opening in said proximal side, aligned with said gangway, so that a worker can access the generally rectangular enclosed area; and said enclosure structure having a fixed rail structure having at least a top rail defining said generally rectangular enclosed area;

said fixed rail structure further comprises a mid rail and a lower rail, said fixed rail structure having a configuration further defining a respective bump out on at least one of said proximal and distal sides thereof, wherein at said respective bump out said mid rail and lower rail transition from being substantially vertically below said top rail to being laterally outward of said top rail to facilitate opening of a hatch cover;

wherein said lower rail transitions outwardly at an outward distance greater than the outward transition of the mid rail;

wherein said fixed rail structure further includes a contour rail at said bump out, said contour rail located below said lower rail.

2. Apparatus as set forth in claim 1, wherein said at least one bump out comprises a first bump out on said proximal side of said enclosure structure and a second bump out on said distal side of said enclosure structure.

* * * * *